United States Patent [19]

McCord

[11] 4,372,452

[45] Feb. 8, 1983

[54] TRANSFER HOIST FOR DISABLED PERSONS

[75] Inventor: Lawless D. McCord, Garden Grove, Calif.

[73] Assignee: Independent Transfer Equipment Co., Garden Grove, Calif.

[21] Appl. No.: 220,123

[22] Filed: Dec. 24, 1980

[51] Int. Cl.[3] ..... B66C 17/06

[52] U.S. Cl. ..... 212/159; 5/85; 105/153; 212/126; 212/142.1; 254/339

[58] Field of Search ..... 212/83, 85, 71, 76, 212/77, 97, 98, 124–126, 131, 134, 135, 142.1, 159; 414/921; 105/148, 150, 153, 154; 254/339; 5/83–88

[56] References Cited

U.S. PATENT DOCUMENTS

| | | | |
|---|---|---|---|
| 2,403,924 | 7/1946 | Herman et al. | 254/339 X |
| 2,918,718 | 12/1959 | Oberwegner | 5/88 X |
| 3,237,572 | 3/1966 | Henderson | 105/153 |
| 4,243,147 | 1/1981 | Twitchell et al. | 414/921 X |

OTHER PUBLICATIONS

Brochure, *Self-Lift,* 1976.
Brochure, *Drualift 500.*
Brochure, *New Self Lift,* 1976.

*Primary Examiner*—Robert G. Sheridan
*Attorney, Agent, or Firm*—Knobbe, Martens, Olson, Hubbard & Bear

[57] ABSTRACT

A lightweight hoist for use in living quarters or patient care facilities to transport disabled persons from one location to another. A flat, unitary, easily manufactured mounting plate provides a main frame that permits the hoist to be easily and inexpensively assembled. The hoist is suspended from an overhead rail and is driven along the rail by a motor. A release mechanism disengages the motor drive to permit the hoist to be manually operated. A flexible lift strap is provided to raise and lower the disabled person. The lift strap is attached to the take-up reel of a motor driven winch. A guideway is included to prevent the lift strap from twisting as it winds and unwinds on the take-up reel of the winch. The winch may be manually driven when the drive motor is deactivated.

5 Claims, 8 Drawing Figures

Fig. 1
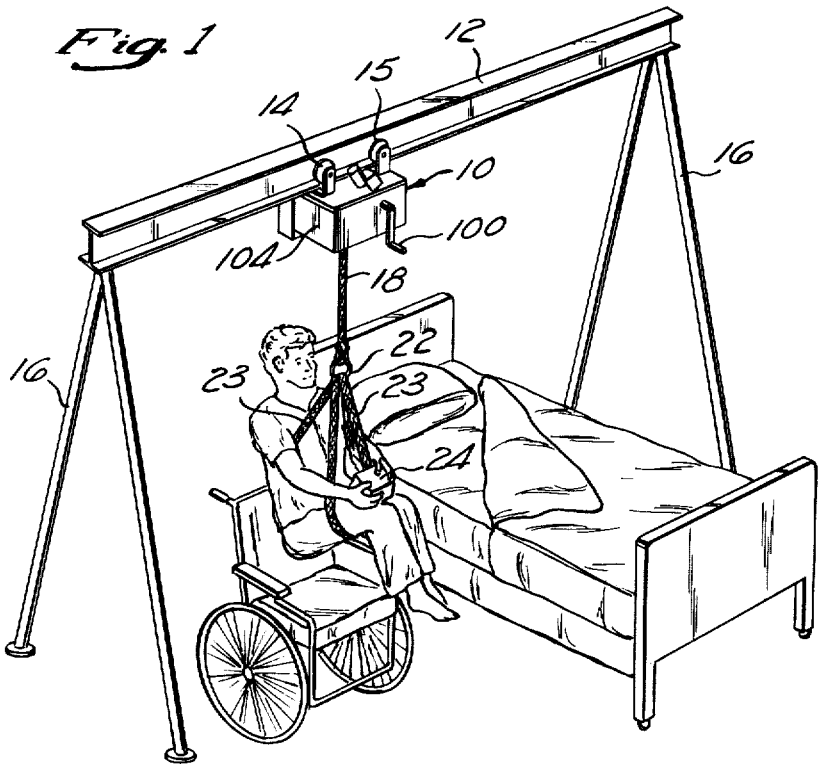
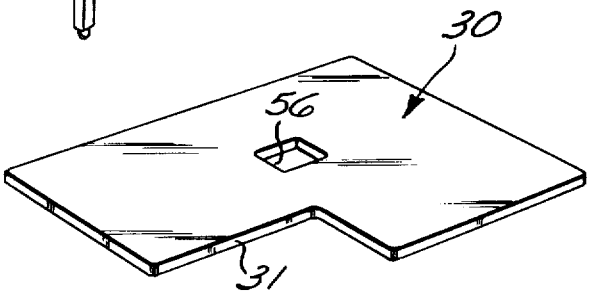
Fig. 2
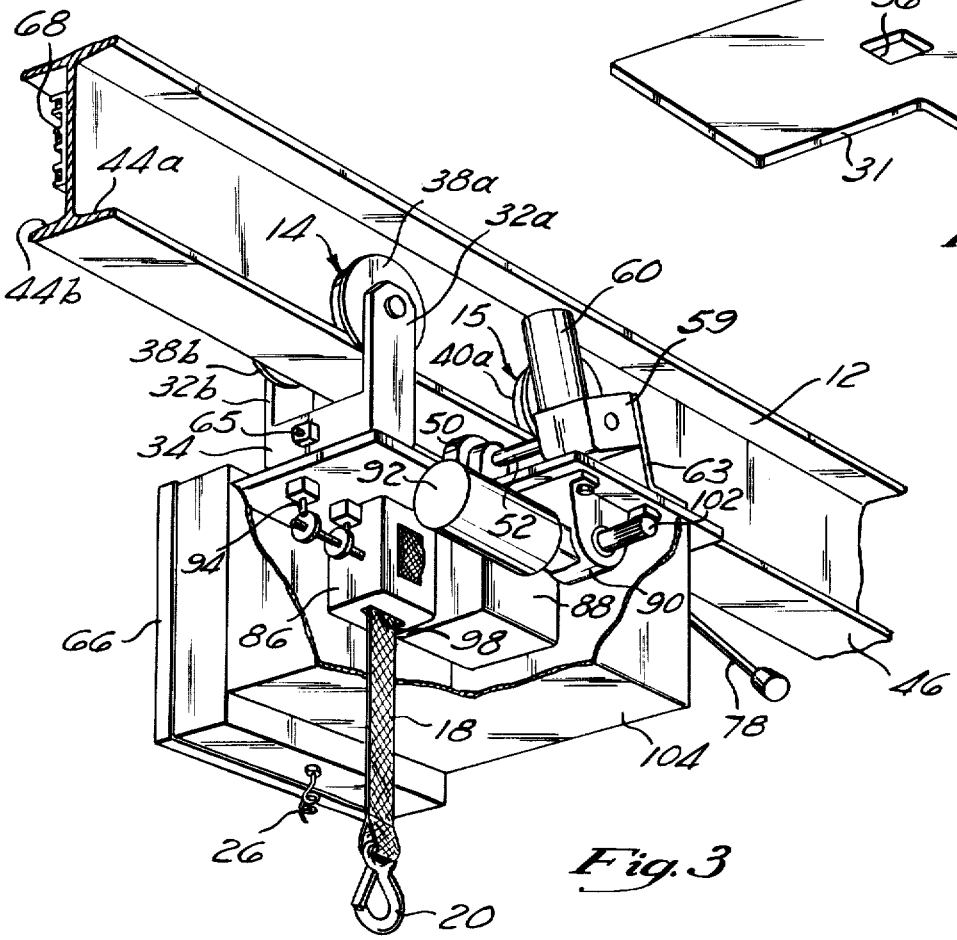
Fig. 3

Fig. 4
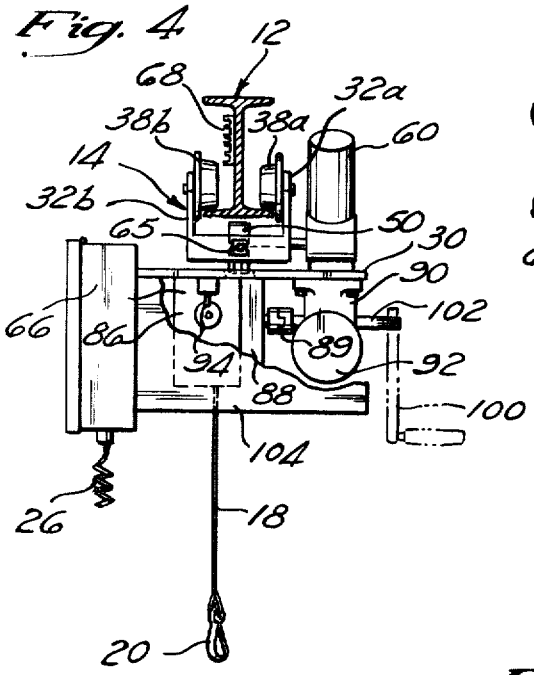
Fig. 5
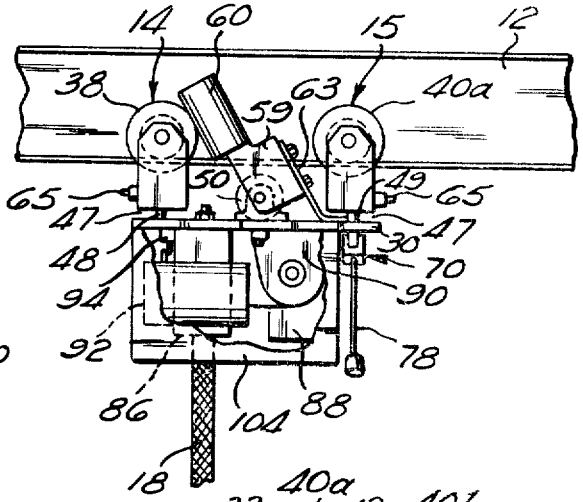
Fig. 6
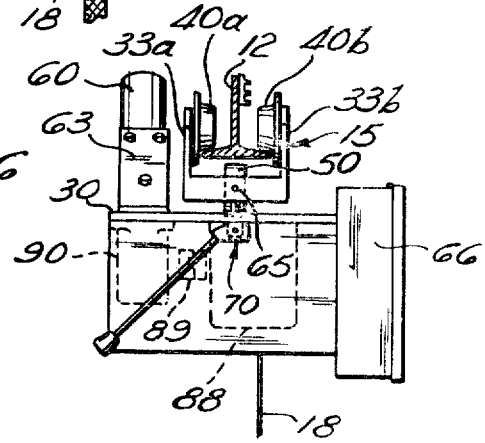
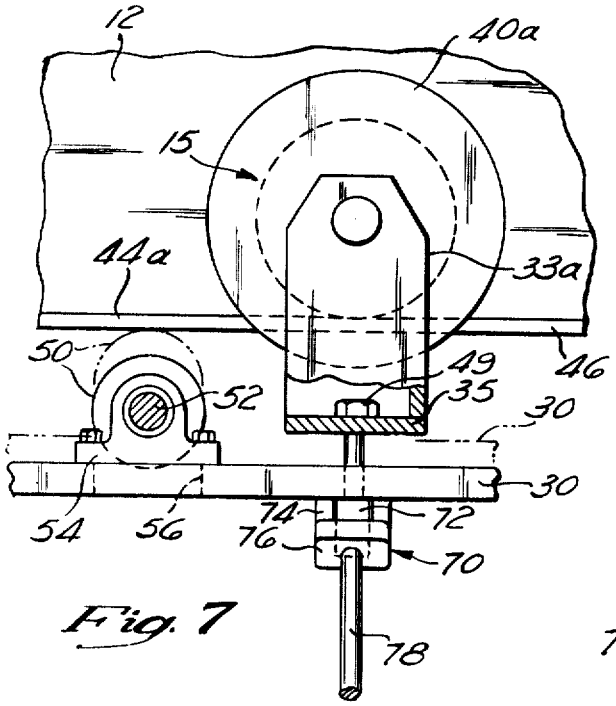
Fig. 7
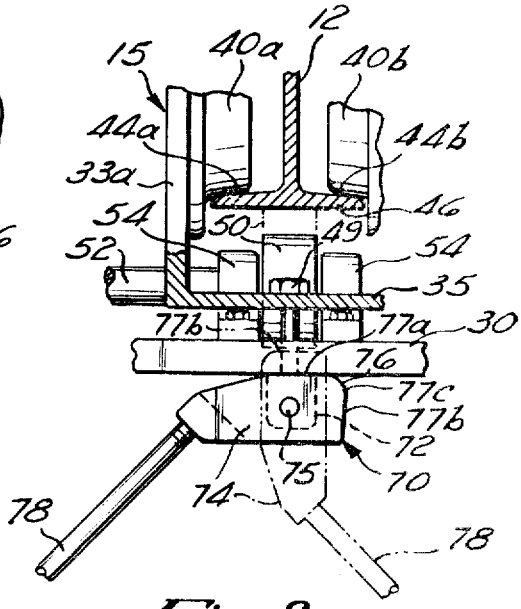
Fig. 8

TRANSFER HOIST FOR DISABLED PERSONS

BACKGROUND OF THE INVENTION

The present invention relates to transfer hoists for use in living quarters or patient care facilities to bodily lift disabled persons and transport them from one location to another.

The hoists are commonly mounted on and suspended from an overhead rail which is supported in A-frames, or attached by support brackets to ceiling joists. Typically, the hoists are used by disabled persons, such as quadriplegic, handicapped, weak and elderly persons, to lift themselves vertically and transport themselves along the overhead rail from one location to another, such as from a bed to a wheelchair, without assistance. This provides such persons with added mobility and independence.

Prior art transfer hoists tend to be modeled after industrial hoists and, therefore, are not entirely satisfactory for use in living quarters or patient care facilities. Excessive weight of the hoists is a particular problem, as they may weigh more than 150 lbs. This makes hoist installation difficult and shipping expensive. Further, since the supporting structure, such as an A-frame, must carry the weight of the overhead rail, the hoist and the person being lifted by the hoist, this structure must be extremely sturdy and rugged. This adds further to the costs associated with the hoist.

In addition, prior art transfer hoists commonly have intricate designs comprising, for example, channelized weldments. Since weldments are expensive to manufacture, this adds significantly to the cost of the hoist. Moreover, the prior art hoists generally include complex guide mechanisms which guide steel cables onto multiple take-up reels. The guide mechanisms and multiple take-up reels are provided to decrease cable wear and prevent the cables from twisting or kinking. However, they are expensive, not only in terms of materials, but in terms of labor necessary to assemble them and mount them on the hoist. In addition, these steel cables and associated mechanisms further increase the weight of the hoist.

In the event of power outages, it is desirable that the hoist be capable of manual operation. The prior art, however, has not provided a manual override that is satisfactory for such manual operation.

SUMMARY OF THE INVENTION

The present invention alleviates these and other problems of the prior art by providing a lightweight, easily manufactured and assembled hoist. In the preferred embodiment, the hoist weighs only about 70 lbs. The hoist includes a main frame comprising a single, unitary, flat plate upon which the component parts of the hoist are mounted.

Since the main frame of the present invention is a unitary plate and does not include any weldments, it is relatively easy to manufacture. Thus, main frame manufacturing costs are reduced considerably. Preferably, the plate is made of aluminum to permit it to be cut from sheets by an ordinary band saw. The lightweight characteristics of aluminum also substantially decrease the overall weight of the hoist.

Further, since the plate is flat, and thus, has no protruding or intricate surfaces, the component parts of the hoists may be easily mounted to the plate by means of appropriate fasteners. This permits the hoist of the present invention to be assembled more rapidly than hoists having more intricate main frames, thereby decreasing assembly costs.

The hoist of the present invention is mounted on and suspended from an overhead rail, and is driven along the rail by a drive wheel, attached to the main frame, which frictionally engages the underside of the rail. A winch, mounted on the main frame, is provided to bodily raise and lower a disabled person. Both the travel of the hoist along the rail and the winch are advantageously controlled by a remote control unit which selectively activates drive motors. In the event of power failure, the travel of the hoist and the winch may be controlled manually.

Manual control of the hoist is accomplished by providing an over-center mechanism which permits the main frame to be lowered relative to the overhead rail. Since the drive wheel, described above, is attached to the main frame, such lowering of the main frame disengages the drive wheel from the rail, and thereby permits the hoist to be manually moved in either direction along the rail. Motor driven operation of the hoist may be restored by raising the main frame so that the drive wheel re-engages the rail.

The over-center mechanism includes a cam which bears against the bottom of the main frame. The above-described raising and lowering of the main frame is the result of the action of the cam as it is manually rotated from one position to another.

Manual control of the lift strap is accomplished by providing a detachable crank handle. This crank handle is connected through a reduction gear to the take-up reel of the winch. Rotation of the crank handle drives the reduction gear, and thus, the winch, and thereby raises and lowers the lifting strap. The gear ratio of the reduction gear provides an advantageous balance of mechanical advantage and travel rate of the lift strap for a crank handle of a given length.

Another important feature of the present invention is that a lightweight, flexible lifting strap is used to lift the disabled person. The strap may be attached to a harness or sling worn by the disabled person to permit such person to be bodily raised and lowered by the winch. A slot is provided in the winch housing to guide the strap onto the take-up reel of the winch so that the strap winds upon itself into a single roll. Thus, no complicated guide mechanisms or additional take-up reels are necessary which further decreases manufacturing costs and reduces weight.

The main frame has a pair of trolley casters rotatably mounted thereon. These casters have wheels which engage and track on the overhead rail. Thus, the main frame and casters cooperate to form a trolley which permits the hoist to roll along the overhead rail. Since the trolley casters are permitted to rotate relative to the main frame, the trolley wheels will maintain their engagement with the rail even if the rail is curved. Thus, the overhead rail may be curved through door openings to permit travel from one room to another.

BRIEF DESCRIPTION OF THE DRAWINGS

These and other advantages of the present invention are best understood through reference to the drawings in which:

FIG. 1 is a perspective view showing the hoist of the present invention being used to lift a disabled person from a bed to a wheelchair; the hoist is mounted on and suspended from an overhead rail supported by A-frames;

FIG. 2 is a perspective view of the main frame of the hoist without any components mounted thereon;

FIG. 3 is a perspective view of the hoist suspended from the overhead rail with a portion of its housing cut away to show the winch and its drive motor and reduction gear;

FIG. 4 is an elevation view of the hoist oriented to show the left side of the hoist of FIG. 1;

FIG. 5 is an elevation view of the hoist oriented to show the front side of the hoist of FIG. 1;

FIG. 6 is an elevation view oriented to show the right side of the hoist of FIG. 1;

FIG. 7 is an enlarged, fragmentary, elevation view, in partial cross-section, showing the relative positions of the rail, trolley caster, main frame, drive wheel, and over-center mechanism after the main frame has been lowered to disengage the drive wheel; and FIG. 8 is an enlarged, fragmentary, elevation view, in partial cross-section, of the rail, trolley caster, drive wheel, main frame, and over-center mechanism shown in FIG. 8 but oriented 90 degrees relative to the view shown in FIG. 8.

DETAILED DESCRIPTION OF THE PREFERRED EMBODIMENT

The present invention comprises a hoist mechanism 10 which is suspended from an overhead I-beam rail 12 by a pair of trolley casters 14,15, as shown in FIG. 1. A pair of A-frames 16 are provided to horizontally support the rail 12 above the floor. However, the rail 12 may alternatively be secured to ceiling joists (not shown). The rail 12 is preferably of aluminum to reduce the weight on the supporting A-frames 16 or ceiling joists.

A lifting strip 18 is suspended from the hoist unit 10. The end of the lifting strap 18 has a hook 20 which receives rings 22 of a harness 23 worn by a disabled person. The hoist 10 raises and lowers the lifting strap 18 to lift the person upward or lower him downward in response to control signals from a remote control unit 24. The control unit 24 is connected to the hoist by a control cable 26 (FIG. 3), and is typically operated by a disabled person himself. In addition to controlling vertical movement, the control unit 24 also controls horizontal movement of the hoist 10 along the rail 12. Thus, by operating the control unit 24, the disabled person may raise himself out of a wheelchair and into bed, or vice versa, as illustrated by FIG. 1.

The hoist mechanism 10 has a main frame 30, shown in FIG. 2, upon which component parts may be mounted. For simplicity, the necessary mounting holes for these component parts are not shown. The frame 30 comprises a single, unitary, flat plate. Although this plate is shown in FIG. 2 as being generally rectangular with a generally rectangular cutout 31 in one corner, it will be understood that other plate configurations may be employed, depending on the type and arrangement of the component parts to be mounted thereon. The simplicity of this flat, unitary plate permits the main frame 30 to be easily manufactured and the hoist 10 to be easily assembled.

In order to permit the hoist 10 to travel along curved sections (not shown) of the rail 12, the trolley casters 14,15 (FIG. 1) are mounted for rotation about a vertical axis on the main frame 30. The casters 14,15 each have a yoke comprising a pair of forks 32(*a*), 32(*b*), and 33(*a*), 33(*b*), respectively, connected by respective bases 34,35, as shown in FIGS. 3, 4, 5, and 6. Trolley wheels 38(*a*), 38(*b*), and 40(*a*), 40(*b*) are rotatably mounted on the forks 32(*a*), 32(*b*) and 33(*a*), 33(*b*), respectively. The trolley wheels 38(*a*), 40(*a*) and 38(*b*), 40(*b*) engage and track on the upper surfaces 44(*a*), 44(*b*), respectively, of the lower flange portion 46 of the I-beam rail 12. The base portions 34,35 of the caster yokes are rotatably mounted on the main frame 30 by respective bolts 48 (FIG. 5) and 49 (FIGS. 5 and 8). Thus, the casters 14,15 cooperate with the main frame 30 to form an overhead trolley, thereby permitting the hoist 10 to travel horizontally along the rail 12. The main frame 30 is spaced from the base portions 34,35 by small gaps 47 to permit the casters 14,15 to rotate relative to the main frame 30, about the vertical axis of the bolts 48,49. Therefore, the casters 14,15 will track on the rail 12 even if the rail 12 is curved in a horizontal plane.

The hoist 10 is driven along the rail 12 by a drive wheel 50 which frictionally engages the underside of the lower flange portion 46 of the I-beam rail 12, as shown in FIG. 3. The drive wheel 50 is connected to an axle 52 which is rotatably mounted on and supported by a pair of struts 54 (FIGS. 7 and 8). The struts 54 are attached to the main frame 30 and are disposed on opposite sides of the wheel 50. A rectangular aperture 56 (FIG. 2) is provided in the main frame 30 below the wheel 50 to permit the wheel 50 to extend therethrough. This allows the main frame 30 to be closer to the rail 12 than would otherwise be possible, and reduces the length of the trolley wheel forks 32,33, thereby increasing the lateral stability of the hoist 10 with respect to the rail 12. The drive wheel axle 52 is connected to the output shaft of a worm drive reduction gear 59 of a reversable drive motor 60 by a Lovejoy coupler 62 (FIG. 4). As shown in FIG. 5, the drive motor 60 and gear 59 are mounted as a unit on an angle iron 63 connected to the main frame 30. Thus, the wheel 50 is driven by the reversable motor 60 through the gear 59 to move the hoist 10 in either direction along the rail 12. Stop plates (not shown), attached to the bottom of the rail 12, cooperate with limit switches 65 on the trolley bases 34,35 to automatically deactivate the drive motor 60 when the hoist 10 reaches the ends of the rail 12.

The drive motor 60 is wired to a control panel 66, mounted on the main frame 30. The control panel 66 has a D.C. power supply and a control circuit, both of which may be of a type well known in the art. The control circuit may be remotely operated by means of the remote control unit 24 (FIG. 1), connected to the control circuit of the control panel 66 by the cable 26. Commercial power is supplied to the D.C. power supply by connecting it, through a trolley shoe or collector (not shown), to a power track 68 mounted on the web portion of the I-beam rail 12.

Since disabled persons tend to rely heavily on their transfer hoists, it is important that these hoists be manually operable in case of a commercial power failure. Accordingly, the drive wheel 50 may be disengaged from the rail 12 to permit the hoist 10 to be manually moved along the rail 12. This is accomplished by providing a relatively inexpensive and simple over-center mechanism 70 which permits the main frame 30 to be lowered, relative to the trolley caster 15, from the position shown in phantom lines in FIGS. 7 and 8 to the position shown in solid lines in FIGS. 7 and 8. Since the drive wheel 50 is attached to the main frame 30, such lowering of the main frame 30 disengages the drive wheel 50 from the flange portion 46 of the rail 12 as shown in FIGS. 7 and 8. The over-center mechanism 70 comprises a yoke 74 rotatably mounted on a tongue 72 by a pin 75. As shown in FIGS. 7 and 8, this mechanism 70 is disposed on the underside of the main frame 30, below the caster 15. The bolt 49, which, as previously mentioned, rotatably mounts the caster base 35 on the main frame 30, extends through bores in the caster base 35 and main frame 30 and is threaded into a bore in the tongue 72 so that the main frame 30 is disposed between the base 35 and the tongue 72, and is supported by the tongue 72. The yoke 74 functions as a cam, and has a surface 76 which bears against the main frame 30. This surface 76 comprises a pair of flat portions 77(*a*) and 77(*b*), disposed at right angles to each other, and connected by a curved, camming portion 77(*c*). The respective planes formed by each of the flat portions 77(*a*), 77(*b*) are parallel to the rotational axis of the yoke 74, and the yoke rotational axis is parallel to the main frame 30. The flat portion 77(*a*) is closer to the rotational axis of the yoke than the flat portion 77(*b*). Thus, if the yoke 74 is positioned so that the portion 77(*a*) bears against the main frame 30, the main frame will be further from the rail 12 than when the yoke 74 is positioned so that the portion 77(*b*) bears against the main frame 30. These positions of the yoke 74 will be referred to as the "lowered position" and "raised position," respectively. By rotating the yoke 74 from its raised position to its lowered position, the camming portion 77(*c*) will lower the main frame 30 to the position shown in solid lines in FIGS. 7 and 8. Conversely, by rotating the yoke 74 from its lowered position to its raised position, the camming portion 77(*c*) will raise the main frame 30 to the position shown in phantom lines in FIGS. 7 and 8. Since the portions 77(*a*), 77(*b*) are flat, they cooperate with the flat main frame to lock the yoke 74 in either of these positions.

As mentioned above, because the drive wheel 50 is mounted on the main frame 30, the above-described lowering of the main frame 30 relative to the caster 15 will cause the drive wheel 50 to be disengaged from the rail flange portion 46, thereby permitting the hoist 10 to be manually moved along the rail 12. The drive wheel 50 may be re-engaged simply by rotating the yoke 74, as shown in phantom in FIGS. 7 and 8, to drive the main frame 30 vertically upward, thereby causing the rail 12 and drive wheel 50 to re-engage. A lever 78 may be attached to the yoke 74 to aid in rotating the yoke 74. Thus, the drive wheel 50 may be engaged or disengaged simply by moving the lever 78.

It is significant that the bolt 49 cooperates with the trolley caster 15, the main frame 30, and the over-center mechanism 70 to permit the main frame 30 and caster 15 to move relative to each other, both rotatably about a vertical axis, and longitudinally, along such vertical axis. For example, it will be recalled that the caster 15 rotates relative to the bolt 49 to permit the hoist 10 to travel along a curved section of the rail 12. Further, as discussed immediately above, the main frame 30, in response to rotation of the over-center mechanism 70, is vertically translated along the bolt 49, as shown in FIGS. 7 and 8. Thus, the bolt 49 provides both a rotational axis and a translational axis for relative movement of the main frame 30 and caster 15.

Since transfer hoists of the type disclosed herein are designed specifically for use in transporting disabled persons, rather than cargo, it is preferable that these hoists be as reliable and trouble-free as possible. Accordingly, hoist 10 of the present invention includes a winch 86 which raises and lowers the lifting strap 18, and thus, the disabled person, without the need for steel cables and their associated complex guide mechanisms. The lift strap 18 is wound on the take-up reel of the winch 86 mounted on the underside of the main frame 30, as shown in FIG. 3. The winch 86 includes a simple, stationary guideway comprising a slot 98 formed in the winch housing, as shown in FIG. 3, to prevent the lift strap 18 from twisting as it winds on the take-up reel. Further, an adjustable limit switch 94, operably connected to the reel of the winch 86, is included as a safety feature to automatically deactivate the drive motor 92, and thus, stop the winch 86, when the lift strap 18 reaches selected upper and lower positions. By way of specific example, the lift strap 18 may be comprised of 1¾ inch wide nylon. However, other suitable materials and strap widths will be apparent to those in the art.

The reel of the winch 86 is connected to the output shaft of a worm drive reduction gear 88 which is mounted on the main frame 30, adjacent to the winch 86. A Lovejoy coupler 89 connects the input shaft of the reduction gear 88 to the output shaft of a worm drive reduction gear 90 of a reversable drive motor 92, mounted as a unit on the underside of the main frame 30, as shown in FIG. 3. Thus, the winch 86 is driven by the drive motor 92 through the reduction gears 90 and 88.

The gear 90 of the drive motor 92 has a gear ratio which, when combined with the gear ratio of the reduction gear 88, yields an overall gear ratio that provides a smooth, powerful, driving force on the winch 86. As a specific example, the gears 88, 90 may have gear ratios of 11 to 1, and 30 to 1, respectively, thereby yielding an overall gear ratio of 330 to 1 for the combination of the reduction gears 88 and 90. Such gear ratio provides a winch drive that is sufficiently powerful to raise and lower the user and sufficiently smooth to prevent the lift strap 18 from being jerked when the drive motor 92 is activated.

Like the drive motor 60, the drive motor 92 is wired to the control panel 66, and advantageously remotely controlled by the control unit 24 (FIG. 1). As a result, the remote control unit 24 controls both the height of the lift strap 18, as well as the position of the hoist 10 on the rail 12. Preferably, both the reduction gears 88, 90 have worm gears which drive respective spur gears at right angles. The engaging teeth of these right angle gears are oriented to prevent the spur gears from driving their respective worm gears, and thus, torque applied to their output shafts will not rotate their respective input shafts. Therefore, the weight of the user on the strap 18 will not unwind the strap 18 when the drive motor 92 is deactivated.

As previously mentioned, it is advantageous that transfer hoists be capable of manual operation. This is particularly important with respect to the winch 86, since, if a power outage were to occur when the disabled person is in the process of being lifted, it may be difficult to remove him from the harness 23 (FIG. 1) and lower him to the floor. Accordingly, the winch 86 may be manually driven to raise or lower the lift strap 18 by inserting the socket of a detachable crank handle 100 onto an externally accessible lug 102 on the output drive shaft of the gear 90, as shown in FIG. 4. Since the output shaft of the gear 90 is connected to the input shaft of the reduction gear 88, rotation of the crank handle 100 will drive the reduction gear 88, and thus, the winch 86, to raise and lower the lift strap 18. Thus, in the event of power failure, the crank handle 100 may be used to manually control the position of the lift strap 18.

The reduction gear 88 has a gear ratio which provides an advantageous balance of mechanical advantage and lift strap travel rate for a crank handle 100 of a given length. By way of specific example, the gear ratio of the reduction gear 88 may be 11 to 1 for a crank handle 100 having a length of 7 inches.

A housing 104 attaches to the main frame 30 to conceal the component parts mounted thereon, as shown in FIGS. 1 and 3, thereby providing an aesthetically pleasing appearance, and safeguarding persons against injury through contact with moving parts or electrical wiring. However, the lug 102 extends through the housing 100 to permit it to be externally accessible. Further, the over-center mechanism 70 is positioned outside the housing 104. Thus, the above-described manual operation of the winch 86 and disengagement of the drive wheel 50 may be accomplished without removing the housing 104.

What is claimed is:

1. A hoist suspended from an overhead rail, for use in living quarters or patient care facilities to bodily lift disabled persons and transport them along said rail from one location to another location within said quarters or facility, said hoist comprising:

trolley means for engaging said overhead rail to permit said hoist to travel along said rail;

a main frame, comprising a unitary, flat, mounting plate;

mounting means for supporting said main frame beneath said trolley means, said mounting means permitting said main frame to move vertically relative to said trolley means;

a winch, mounted on said main frame, for bodily lifting and lowering a disabled person;

power transmitting means, mounted on said main frame, for driving said winch;

a drive wheel, mounted on said main frame, and engaging said overhead rail;

a motor, mounted on said main frame, connected to drive said drive wheel to move said hoist along said rail;

cam means for selectively lowering said main frame relative to said trolley means to disengage said drive wheel and said rail, thereby permitting said hoist to be manually moved along said rail; and said cam means comprising:

a support member, connected to said trolley means;

a cam member, rotatably mounted about a rotational axis on said support member and having first and second surfaces alternately bearing against said main frame, said first surface being closer to said rotational axis than said second surface to support said main frame in a first position relative to said rail when said first surface bears against said main frame and in a second position relative to said rail when said second surface bears against said main frame; and means for rotating said cam member to alternately place said first and second surfaces in a bearing relationship with said main frame.

2. A hoist, as defined in claim 1, wherein said means for rotating said cam member is a lever, attached to said cam member.

3. A lightweight, easily manufactured and assembled hoist for use in living quarters and patient care facilities, said hoist suspended from an overhead rail and comprising:

trolley means for engaging said overhead rail to permit said hoist to travel along said rail;

a main frame, comprising a unitary, flat, mounting plate;

a drive wheel mounted on said main frame, for engaging said overhead rail frame, for driving said hoist;

a first motor, mounted on said main frame, connected to drive said drive wheel to move said hoist along said rail;

a vertical rod for supporting said main frame beneath said trolley means, said vertical rod providing a vertical axis for (i) rotational movement of said trolley means about said axis relative to said main frame to permit said hoist to travel through curved sections of said rail, and (ii) for translational movement of said main frame along said axis relative to said trolley means;

override means for moving said main frame along said vertical axis to either (i) a first position causing said drive wheel to engage said rail to permit said motion to drive said hoist along said rail, or (ii) a second position causing said drive wheel to disengage said rail to permit said hoist to be manually moved along said rail; said override means comprising:

a first member, connected to said mounting means;

a second member, mounted for rotation on said first member, and having a surface bearing against said main frame, said first and second members cooperating, and said bearing surface formed, to cause said bearing surface to move said main frame to either said first position or said second position in response to rotation of said second member;

a winch, mounted on said main frame, comprising:

a single take-up reel;

a flexible lift strap, attached to said take-up reel;

a stationary guideway to prevent said lift strap from twisting as it winds and unwinds on said single take-up reel;

a second motor, mounted on said main frame, for driving said winch; and a reduction gear, connected between said second motor and said winch, said second motor driving said winch through said reduction gear, the drive shaft of said reduction gear having an externally accessible lug to permit said reduction gear, and thus, said winch to be driven manually when said motor is deactivated, by rotating said lug.

4. A hoist as defined in claim 3, wherein said vertical rod attaches said trolley means to said first member of said override means, and extends through a bore in said main frame, said main frame sliding on said vertical rod in response to rotation of said second member of said override means.

5. In a lightweight, motor driven hoist for use in living quarters or patient care facilities to lift disabled persons and transport them from one location to another, said hoist including (i) a wheeled trolley for suspending said hoist from an overhead rail, and (ii) a motor driven drive wheel for engaging said overhead rail to drive said hoist along said rail, the improvement comprising:

a main frame comprising a unitary, flat plate for mounting the component parts of said hoist, including said drive wheel; and override means for selectively disengaging said motor driven drive wheel from said overhead rail, by manually moving said main frame relative to said wheeled trolley, to permit said hoist to be manually moved along said overhead rail, said override means comprising:

a vertical rod, attached to said wheeled trolley and extending through a bore in said main frame, for supporting said main frame beneath said wheeled trolley, said vertical rod providing a vertical axis for (i) rotational movement of said wheeled trolley, relative to said main frame, about said axis, to permit said hoist to travel through curved portions of said rail, and (ii) for transitional movement of said main frame, relative to said wheeled trolley, along said axis, to either (i) a first position causing said drive wheel to engage said rail to permit said hoist to be motor driven, or (ii) a second position causing said drive wheel to disengage said rail to permit said hoist to be moved along said rail manually; and a mechanism for providing said translational movement of said main frame along said axis to either said first position or said second position, said mechanism comprising:

a support member, attached to said vertical rod;

a cam member, rotatably mounted on said support member, and having a surface bearing against said main frame, said surface formed to move said main frame to either said first position or said second position in response to rotation of said cam member, and a lever, attached to said cam member, for manually rotating said cam member.

* * * * *